US007284899B2

(12) United States Patent
Nakano

(10) Patent No.: US 7,284,899 B2
(45) Date of Patent: Oct. 23, 2007

(54) EMULSIFICATION/DISPERSION SYSTEM USING MULTISTAGE DEPRESSURIZATION MODULE AND METHOD FOR PRODUCING EMULSIFIED/DISPERSED LIQUID

(76) Inventor: Mitsuru Nakano, Famiruhaitsu-Sakai ll-bankan 718, 116-1, Kaisan-cho 2-cho, Sakai-shi, Osaka (JP) 590-0982

( * ) Notice: Subject to any disclaimer, the term of this patent is extended or adjusted under 35 U.S.C. 154(b) by 497 days.

(21) Appl. No.: 10/501,031

(22) PCT Filed: Jan. 9, 2003

(86) PCT No.: PCT/JP03/00091

§ 371 (c)(1),
(2), (4) Date: Jul. 9, 2004

(87) PCT Pub. No.: WO03/059497

PCT Pub. Date: Jul. 24, 2003

(65) Prior Publication Data

US 2005/0041523 A1 Feb. 24, 2005

(30) Foreign Application Priority Data

Jan. 9, 2002 (JP) ..... 2002-002447

(51) Int. Cl.
*B01F 5/08* (2006.01)

(52) U.S. Cl. ..... 366/176.1; 366/149

(58) Field of Classification Search .. 366/176.1–176.4, 366/149, 336–340, 181.5; 138/40; 516/928–931
See application file for complete search history.

(56) References Cited

U.S. PATENT DOCUMENTS 4,352,573 A * 10/1982 Pandolfe ..... 366/176.2
5,720,551 A 2/1998 Shechter
6,149,293 A * 11/2000 Pavese ..... 366/119
6,413,706 B1 7/2002 Nakanishi et al.
7,207,712 B2 * 4/2007 Kozyuk ..... 138/40
2005/0041523 A1 * 2/2005 Nakano ..... 366/176.1

FOREIGN PATENT DOCUMENTS

| | | |
|---|---|---|
| EP | 196280 A2 * | 10/1986 |
| EP | 0 768 114 | 4/1997 |
| EP | 1 249 270 | 10/2002 |
| JP | 9-507791 | 8/1997 |
| JP | 2000-210546 | 8/2000 |
| JP | 2001-27795 | 1/2001 |
| WO | WO 96/14141 | 5/1996 |

* cited by examiner

*Primary Examiner*—Charles E. Cooley
(74) *Attorney, Agent, or Firm*—Hamre, Schumann, Mueller & Larson, P.C.

(57) ABSTRACT

Disclosed is an emulsification/dispersion system, which comprises an emulsification/dispersion apparatus, and a multistage depressurization module connected to the outlet side of the emulsification/dispersion apparatus directly or through a heat exchanger. The multistage depressurization module is provided with a plurality of depressurization cells arranged in a multistage manner through seals, and adapted to apply a given backpressure to the emulsification/dispersion apparatus and to reduce the backpressure in a stepwise manner through the series of depressurization cells so as to prevent the occurrence of bubbling even when an emulsified liquid is released to atmosphere. The present invention can prevent the occurrence of bubbling in both processes of forming an emulsified liquid and taking out the emulsified liquid as a product.

13 Claims, 13 Drawing Sheets

MULTISTAGE EMULSIFICATION/DISPERSION MODULE

EMULSIFICATION/DISPERSION SYSTEM USING MULTISTAGE DEPRESSURIZATION MODULE AND METHOD FOR PRODUCING EMULSIFIED/DISPERSED LIQUID

TECHNICAL FIELD

The present invention relates to an apparatus and method for emulsifying and dispersing a desired material in a base liquid to form an emulsified/dispersed liquid, and more particularly to an apparatus and method for giving a shearing force to a liquid so as to facilitate emulsification/dispersion.

BACKGROUND ART

Heretofore, there have been known various types of emulsification/dispersion apparatuses. Irrespective of the types, such as rotary and high-pressure types, all of these emulsification/dispersion apparatuses are intended to perform emulsification/dispersion while giving a high shearing force to a liquid. For example, a high-pressure type homogenizer is designed to perform emulsification/dispersion by converting a pressure into a jet flow, and bringing the jet flow into collision with a wall or reversing its course to convert the kinetic energy of the jet flow into shear energy.

If a liquid receives such a high shearing force in a site having some heterogeneity or unevenness, such as difference in pressure or flow velocity (under off-balanced conditions), air dissolved in the liquid or air remaining in the system will become bubbles or cause a bubbling phenomenon to undesirably form large particles. In this context, a technique of introducing a backpressure has been employed to prevent the bubbling from occurring. For controlling the backpressure, a Gaulin-type homogenizer is provided with a two-way valve, and a microfluidizer is provided with a backpressure chamber.

In conjunction with recent developments of an apparatus capable of injecting higher energy in response to the need for higher emulsification/dispersion performance, the bubbling phenomenon comes to the front as a serious problem. While bubbling likely to occur within an apparatus can be suppressed by increasing a backpressure, another bubbling will be caused by pressure drop immediately after the liquid is discharged from the apparatus.

In case where a target material is power or fine particles, upon occurrence of the bubbling, the resulting bubbles attached onto the surfaces of the particles cause poor wettability, and an aerosol is liable to be formed even in an emulsion state. The bubbles also absorb energy to cause energy loss, and oxidization in a treated material. For example, in case of unsaturated fatty acid, an oxidative reaction under a high temperature causes deterioration in product quality. Moreover, if the amount of an emulsifying agent and/or a dispersing agent is increased to reduce the interfacial tension of aquatic systems, small bubbles generated in the shear region will further attach onto the interface to cause the deterioration in release of the bubbles.

As above, the conventional concept is directed to injecting higher energy so as to facilitate micronization, and prevent bubbling by means of increased backpressure, or is based on an idea giving greater importance to the upstream of an emulsification/dispersion process. Such an approach cannot effectively prevent the occurrence of bubbling.

DISCLOSURE OF INVENTION

A fundamental object of the present invention is to provide an emulsification/dispersion system and method capable of fully eliminating bubbles, or obtaining an emulsified/dispersed liquid as a product free from the risk of its deterioration even if some bubbles exist therein.

A fundamental idea of the present invention is originated on the basis of the time point when a created emulsified/dispersed liquid is released to atmosphere, and formulated to prevent the bubbling phenomenon from being induced by a pressure drop inevitably occurring at that time point. That is, the origin of conception is set at the downstream of an emulsification/dispersion process, and then various conditions in the upstream, such as the amount of energy to be injected, are adjusted accordingly.

An emulsification/dispersion system according to a first aspect of the present invention comprises a combination of a multistage emulsification/dispersion module and a multistage depressurization module.

The multistage emulsification/dispersion module includes first to third absorption cells axially connected in series with each other through a seal. Given that the inner diameters of the first, second and third absorption cells are $D_1$, $D_2$ and $D_3$, respectively, the following relationship is satisfied: $D_2>D_3>D_1$. The seal has an inner diameter $D_S$ satisfying the following relationship: $D_S \geqq D_2$.

The multistage depressurization module is connected to the multistage emulsification/dispersion module through a communication passage. This multistage depressurization module fundamentally comprises at least two depressurization cells (depressurization members) axially connected with one another in a multistage manner through a seal (connecting member) having an inner diameter greater than that of the depressurization member. The multistage depressurization module is operable to provide a required backpressure to the multistage emulsification/dispersion module, and to reduce the backpressure through the depressurization cells in a stepwise manner so that the depressurization cell in the final stage provides a reduced pressure causing no bubbling when an emulsified/dispersed liquid is released to atmosphere.

The depressurization cells may have the same size having a given inner diameter, or may have different inner diameters which are stepwise increased. The seal interposed between the depressurization cells has a function of shutting off the respective depressurizing functions in the adjacent depressurization cells. In other words, the entire reduced pressure of the multistage depressurization module can be considered as the sum of the respective reduced pressures in the depressurization cells, and the respective inner diameters and the number of the depressurization cells may be determined depending on a backpressure required for the multistage emulsification/dispersion module.

Given that the respective absorption cells forming a passage in the multistage emulsification/dispersion module, the communication passage, and the respective depressurization cells forming a passage in the multistage depressurization module are defined as individual passage units, and the entire passage from the inlet of the multistage emulsification/dispersion module to the outlet of the multistage depressurization module is constructed by these passage units, the entire passage is defined by the passage units having in combination at least three different passage diameters, and the combination is determined according to the following rules.

(1) Each of the passage units has either one of at least three different passage diameters $D_S$, $D_M$, $D_B$ ($D_S<D_M<D_B$). When the passage unit with the passage diameter $D_M$ is connected to the downstream of the passage unit with the passage diameter $D_S$, the passage unit with the passage diameter $D_B$ is connected between these two passage units.

(2) The rule (1) is not essentially applied when any of the passage units is connected to the upstream side of the passage unit with the smallest passage diameter.

The multistage depressurization module according to the present invention can also be applied to a conventional rotary or high-pressure-type emulsification/dispersion apparatus. In this case, the multistage depressurization module gives a required backpressure to the emulsification/dispersion apparatus to prevent bubbling in the emulsification/dispersion apparatus, and reduces the backpressure in a stepwise manner to finally have a reduced pressure causing no bubbling even if an emulsified/dispersed liquid is released to atmosphere.

A method for producing an emulsified/dispersed liquid, according to a second aspect of the present invention, comprises the steps of giving a shearing force to a liquid to emulsify/disperse the liquid while applying a backpressure thereto, and reducing the backpressure in a stepwise manner using a plurality of depressurization cells so as to allow the liquid to finally have a reduced pressure causing no bubbling even if it is released to atmosphere.

Further, in case of an integrated multistage emulsification/dispersion apparatus, the emulsification/dispersion operation can be performed while maintaining a liquid in its critical state. Specifically, a method for producing an emulsified/dispersed liquid, according to a third aspect of the present invention, comprises the steps of pressurizing and heating a dispersion liquid up to its critical pressure or more and its critical temperature or more, to achieve the critical state, on the upstream side of an integrated multistage emulsification/dispersion apparatus, and supply the dispersion liquid to the integrated multistage emulsification/dispersion apparatus. If the dispersion liquid is in the critical state, the solubility and/or dispersibility of a material to be emulsified/dispersed will be increased to provide further enhanced emulsification/dispersion performance.

In the integrated multistage emulsification/dispersion apparatus, the emulsification/dispersion operation in the critical state allows the backpressure to be given to the dispersion liquid at a sufficient high value, and the backpressure is reduced in a stepwise manner using multistage depressurization cells. Even through the critical state is released to transform the emulsified/dispersed liquid into the liquid phase through the depressurization, the pressure can be reduced in a stepwise manner while appropriately assuring an internal backpressure, to obtain a desired emulsified/dispersed liquid without bubbling.

In this manner, the system of the present invention is constructed based on the pressure causing no bubbling even if an emulsified/dispersed liquid is released to atmosphere. That is, in accordance with this pressure, the multistage depressurization module is designed to provide a backpressure required for the emulsification/dispersion apparatus, or a backpressure required for suppressing the occurrence of bubbling in the apparatus.

This approach makes it possible to reliably suppress not only bubbling in the emulsification/dispersion apparatus, but also bubbling which would otherwise occur when the emulsified/dispersed liquid is released to atmosphere in the final stage.

Generally, in case where a high shearing force is applied to a liquid in this type of emulsification/dispersion system or apparatus, if the site has some heterogeneity or unevenness, (if the balance of flow velocity or pressure is lost), bubbling will occur to cause uneven distribution of particles or formation of large particles. The conventional tourniquet is directed to increase the liquid pressure at a high value so as to prevent this bubbling phenomenon. However, this measure inevitably involves a large amount of unprofitable energy consumption. By contrast, the emulsification/dispersion apparatus according to the present invention is intended to prevent the occurrence of bubbling without applying an excessively high pressure to a liquid, based on the aforementioned construction. This makes it possible to evenly disperse particles so as to prevent the formation of large particles, while reducing energy consumption.

BRIEF DESCRIPTION OF DRAWINGS

Other features and advantages of the present invention will be apparent from the detailed description and from the accompanying drawings. In the accompanying drawings, a common element or component is defined by the same reference numeral or code.

BEST MODE FOR CARRYING OUT THE INVENTION

First Embodiment

Figure 1:
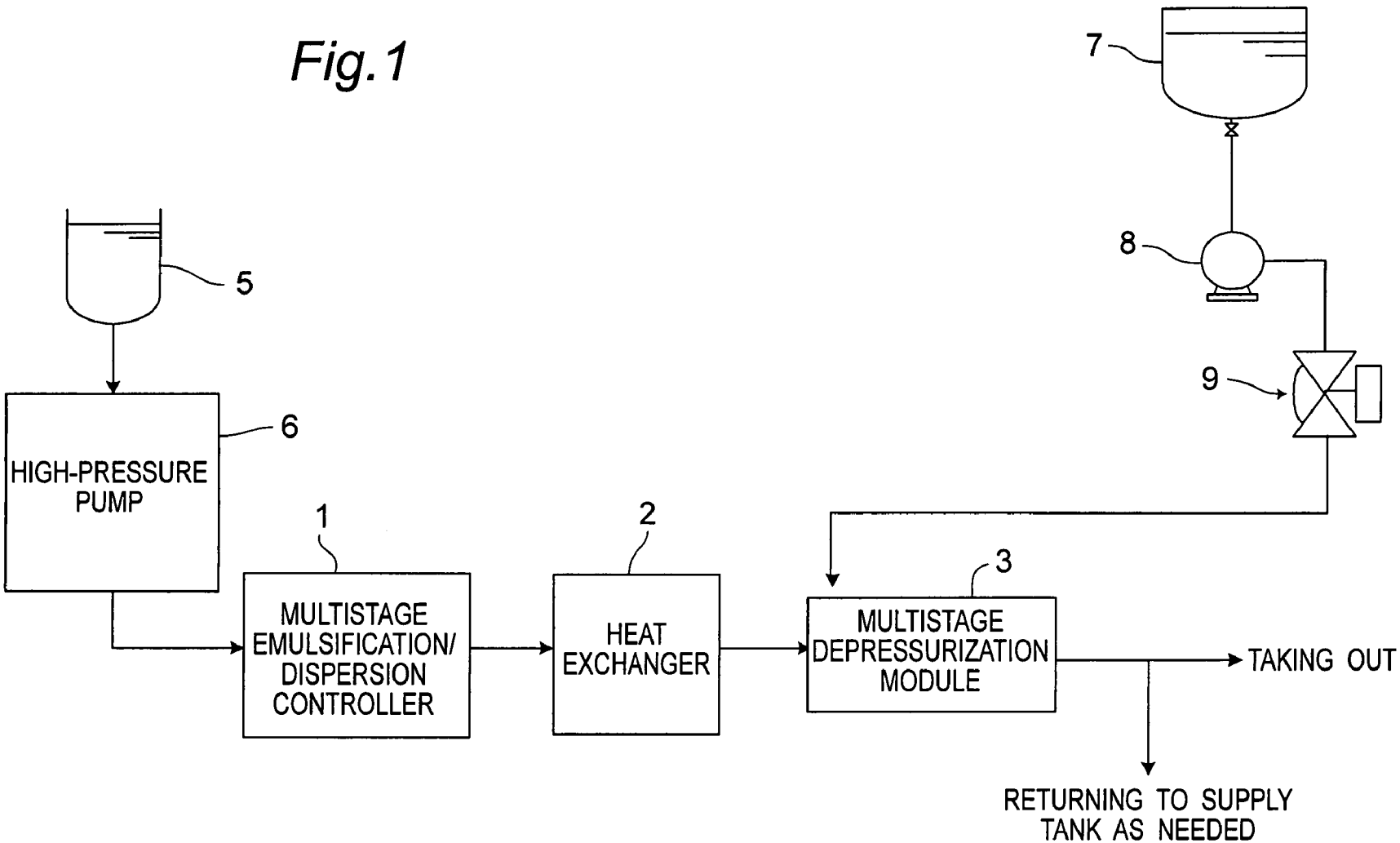
FIG. 1 is a block diagram of an emulsification/dispersion system according to a first embodiment of the present invention.

As shown in FIG. 1, an emulsification/dispersion system according to a first embodiment of the present invention fundamentally comprises a multistage emulsification/dispersion controller 1, and a multistage depressurization module 3 located on the downstream of the multistage emulsification/dispersion controller 1 while interposing a heat exchanger 2 therebetween.

A liquid to be emulsified/dispersed, which is stored in a material supply tank 5, is supplied to the multistage emulsification/dispersion controller 1, in the state after the liquid is pressurized at a given high pressure by a high-pressure pump 6. As described in detail later, the multistage emulsification/dispersion controller 1 is operable to perform an emulsification/dispersion operation based on liquid-liquid shear caused by a jet flow. The multistage depressurization module 3 on the downstream thereof is operable to apply a given backpressure to the multistage emulsification/dispersion controller 1 through the heat exchanger 2 so as to prevent the occurrence of bubbling in the multistage emulsification/dispersion controller 1.

The heat exchanger 2 is operable to cool the liquid heated at a high temperature during the emulsification/dispersion operation based on the shear, so as to prevent the occurrence of bubbling. Depending on an intended product, it is required to avoid such a high temperature. In this case, the heat exchanger 2 is may be omitted, and the multistage depressurization module 3 may be connected directly to the multistage emulsification/dispersion controller 1.

In the first embodiment, in order to add an auxiliary material necessary for the emulsified/dispersed liquid, a liquid contained in a second supply tank 7 is supplied to the inlet side of the multistage depressurization module 3 through a supply pump 8 and a supply valve 9, at a given pressure equal to or greater than a backpressure.

The multistage depressurization module 3 is operable to reduce the pressure (backpressure) of the emulsified/dispersed liquid in a stepwise manner, to the extent of causing no bubbling even if the liquid is released to atmosphere at an outlet portion of the multistage depressurization module 3. The emulsified/dispersed liquid depressurized by the multistage depressurization module 3 may be taken out of the system as a final product, or may be returned to the first supply tank 6 and re-emulsified/dispersed according to need.

Figure 2:
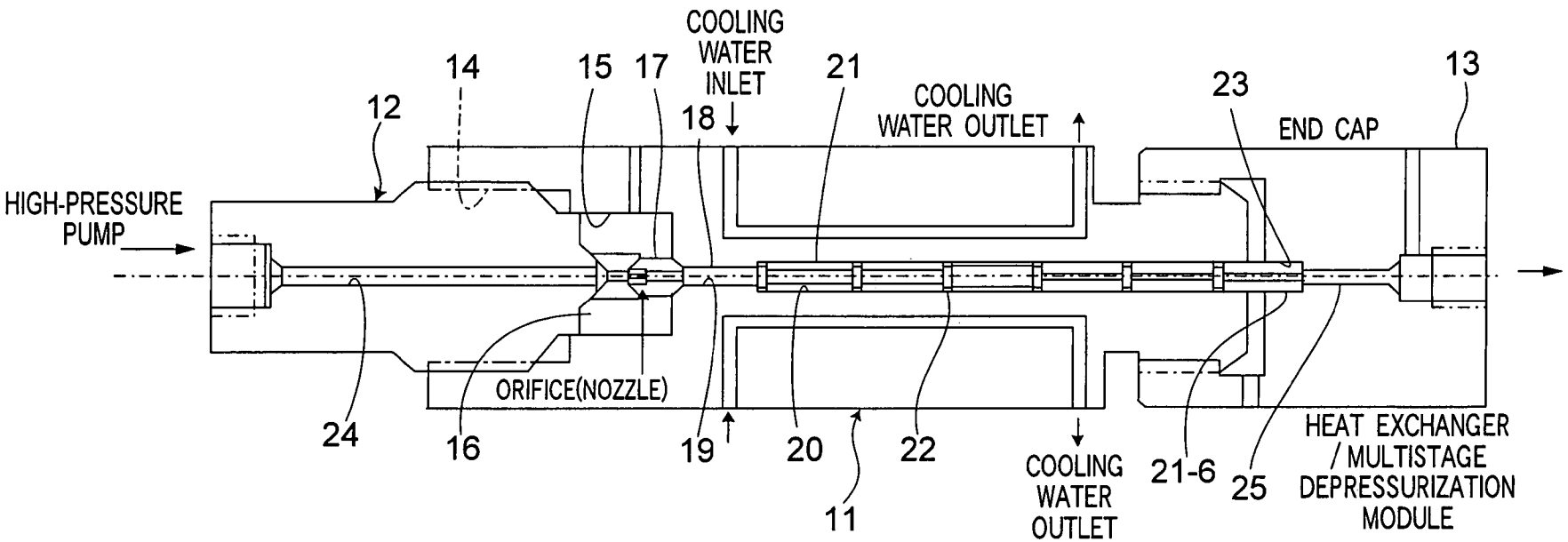
FIG. 2 is an axial sectional view of a multistage emulsification/dispersion module 1 in FIG. 1.

One specific example of the multistage emulsification/dispersion controller 1 is shown in FIG. 2. As shown in FIG. 2, the multistage emulsification/dispersion controller 1 comprises a columnar body 11, a connector 12 connected at a first axial end of the body 11 to introduce into the body 11 a liquid pressurized by a high-pressure pump (6 in FIG. 1), and an end cap 13 connected at a second axial end of the body 11.

The first end of the body 11 is formed with a threaded hole for threadingly engaging with the outer periphery of the connector 12, and a hole 15 steppedly formed to continue from the threaded hole 14 and have a smaller inner diameter than that of the threaded hole 14. A nozzle member 16 is fitted into the hole 15. The-nozzle member 16 is pressingly held on the bottom of the hole 15 by a shoulder of the connector 12 formed at the inner edge thereof. The body 11 is internally formed with an axial hole 19 extending coaxially with a nozzle 17 held by the nozzle member 16, to define a first passage 18 (inner diameter: D0), and a second axial hole 20 axially continuing from the first axial hole 19 and having an inner diameter greater than that of the first axial hole 19.

Six absorption cells 21 are inserted from the second axial end into the second axial hole 20 in a multistage manner while interposing a ring-shaped seal 22 therebetween. The final-stage absorption cell 21-6 is fittingly held by an axial hole 23 formed in the end cap 13 connected to the second end of the body 11.

The 4-th absorption cell 21-4 has an inner diameter D2 greater than an inner diameter D1, and each of the 5-th and 6-th absorption cells 21-5, 21-6 adjacent to the 4-th absorption cell 21-4 has an inner diameter D3 less than the inner diameter D1 of each of the three absorption cells 21-1, 21-2, 21-3 (D2, D0>D1>D3).

In the above arrangement, the absorption cells 21-1, 21-2 and 21-3 are operative to apply a backpressure to the first passage 18, and the absorption cells 21-5, 21-6 with the smallest inner diameter are operative to apply a given backpressure to the 4-th absorption cell 21-4 with the relatively large inner diameter D2.

Each of the ring-shaped seals 22 has an inner diameter Ds greater than the largest inner diameter D2. Thus, the ring-shaped seals 22 can instantaneously absorb or relax a pressure so as to allow each of the absorption cells 21 to reliably bring out a depressurizing effect.

That is, the above arrangement is designed such that the first passage 18, in which the strongest shearing force is to be generated, is applied with a backpressure sufficient to prevent bubbling likely to be induced by the strong shearing force, and the 4-th absorption cell 21-4, in which the pressure relaxation is to be induced, is applied with a backpressure from the 5-th and 6-th absorption cells with the smaller diameter to prevent the occurrence of bubbling due to the pressure relaxation. A second passage 25 connected with the 6-th absorption cell 21-6 has an inner diameter sufficiently greater than the inner diameter D3 of the 6-th absorption cell 21-6. The second passage 25 is connected to the heat exchanger 2 in the subsequent stage.

A liquid pressurized by the high-pressure pump 6, for example, at 2,000 bar or more, is injected into the first passage 19 through the axial hole 24 of the connector 12 in the form of a high-speed jet flow. The jet flow injected into the first passage 19 gives a large sharing force to the liquid residing therearound while losing its own kinetic energy, so as to induce emulsification/dispersion therein, and flows into the absorption cells 21 to give a shearing force to the liquid residing in the absorption cells 21 so as to induce emulsification/dispersion therein.

Each of the absorption cells 21 herein means a type having a small-diameter axial hole in which the kinetic energy of a jet flow flowing along the axis of the axial hole is gradually lost while being converted into shear energy and thermal energy due to the liquid-liquid shear between the jet flow and a liquid residing around the jet flow. The respective inner diameters and the stage-number of the absorption cells 21 are critical design factors to obtain a strong emulsification/dispersion function without bubbling.

Figure 3:
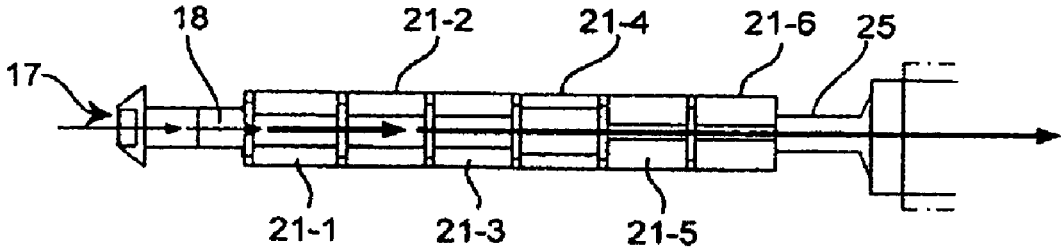
FIG. 3 is an explanatory sectional view of the relationship between the respective inner diameters of absorption cells in the multistage emulsification/dispersion module 1.

FIG. 3 schematically shows one example of the absorption cells. As shown in FIG. 3, three absorption cells 21-1, 21-2, 21-3 continuing from a first passage 18 have a common inner diameter D1 less than the passage diameter D0 of the first passage 18. Two absorption cells 21-5, 21-6 with the smallest diameter $D_3$ and a subsequent multistage depressurization module 3 are operative to apply a backpressure to a 4-th absorption cell 25 with a larger passage diameter $D_2$ so as to prevent the occurrence of bubbling which would be otherwise caused by pressure relaxation in the 4-th absorption cell 25.

Figure 4:
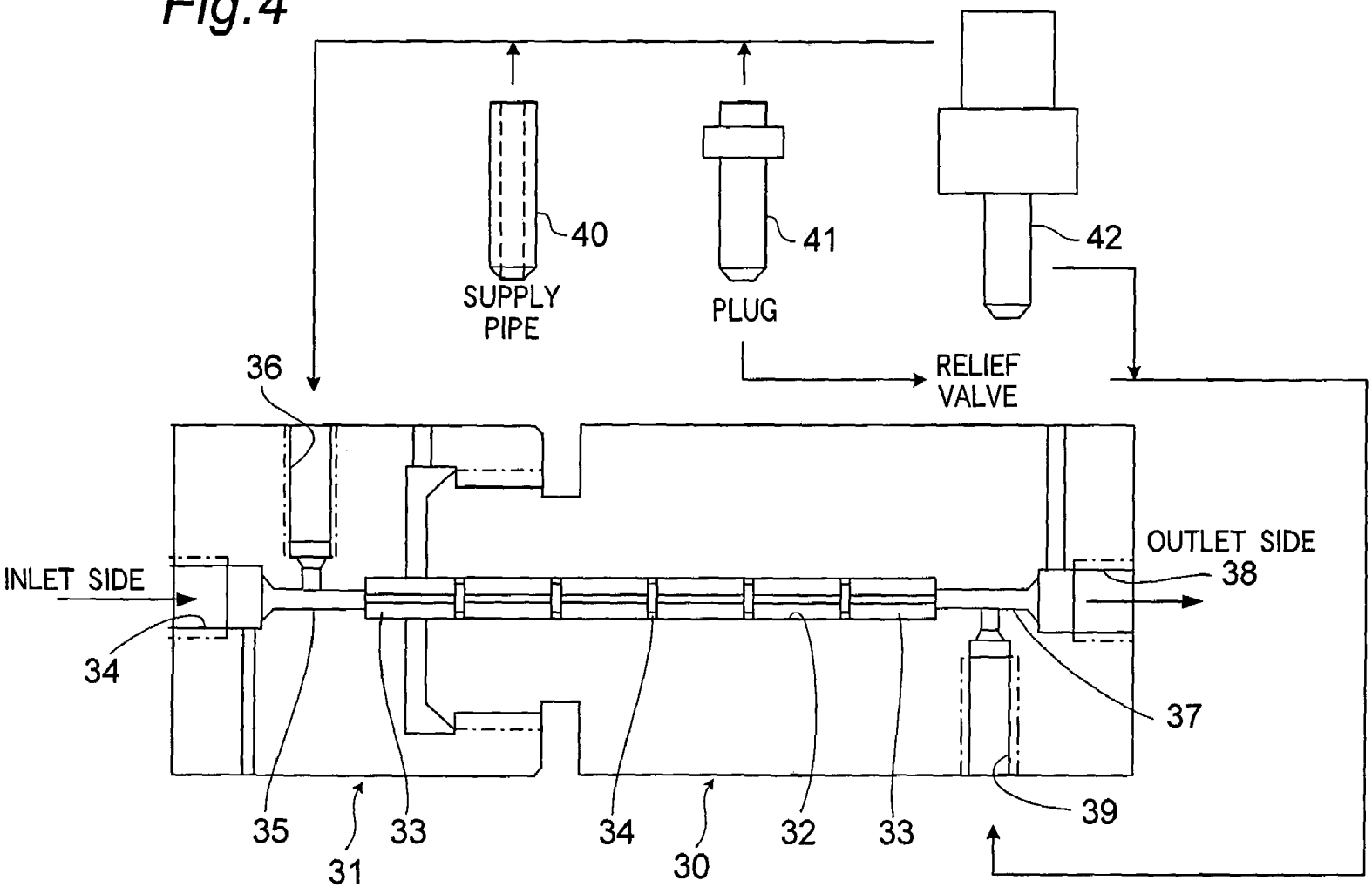
FIG. 4 is an explanatory axial sectional view of a multistage depressurization module 3 in FIG. 1.

FIG. 4 shows one example of the multistage depressurization module 3. This multistage depressurization module 3 comprises a columnar module body 30, and a columnar inlet-side end cap 31 threadingly engaged with a threaded portion formed in one end of the module body 30. Six depressurization cells 33 are inserted into an axial hole 32 formed along the axis of the module body 30, while interposing a seal 34 therebetween, and held between the end cap 31 and the module body 30.

The end cap 31 is formed with an inlet 34 connected to a heat exchanger (2 in FIG. 1), and a passage 35 continuing from the inlet 34, each of which extends in the axial direction. The end cap 31 is also formed with a first side port 36 connected to the passage 35 from the radial direction. The rear end of the module body 30 is formed with a passage 37 coaxial with the axial hole 32, an outlet 38 continuing from the passage 37, and a second side port 39 connected to the passage 37 from the radial direction.

In order to construct a suitable system for an intended product, either one of a pipe 40, a plug 41 and a relief valve 42 is attached to the first side port 36, and either one of a plug 41 and a relief valve 42 is attached to the second side port 39.

While the six depressurization cells 33 used in this example have the same inner diameter, the same outer diameter and the same axial length, it is not essential to design them in the same size.

The depressurizing function (downstream end) and the pressurizing function (upstream end) of the depressurization cells will be verified below.

Figure 5:
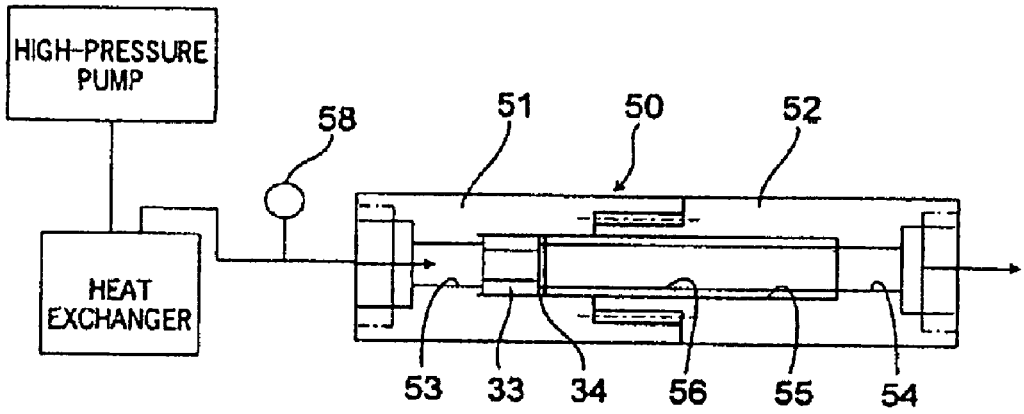
FIG. 5 is an explanatory sectional view showing a testing unit for demonstrating the action of a depressurization cells for use in the multistage depressurization module.

FIG. 5 schematically shows a testing unit for actually measuring the depressurizing (pressurizing) function of the depressurizations cells 33. As shown in FIG. 5, a testing unit body 50 was composed of inlet-side and outlet-side columnar members 51, 52 threadingly engageable with one another in the axial direction. A large-diameter axial hole 55 was formed between an inlet-side passage 53 and an outlet-side passage 54, and a holder tube 56 was inserted into the axial hole 55 to hold the depressurization cell 33 through the seal 34 in the axial direction. In order to attach the depressurization cells 33 to the axial hole 55 one by one in a number of 2, 3, - - , 6, the holder tube 56 was prepared in a plural number in such a manner that each of them has a length corresponding to the number of the depressurization cells 33 to be inserted.

As the depressurizations cells 33 for use in the test, two type: one having an inner diameter of 0.75 mm and a length of 10 mm, and the other having an inner diameter of 1.0 mm and a length of 10 mm, were prepared. The seal 34 was prepared to have an inner diameter of 2.6 mm and a thickness of about 1.5 mm.

The diameter of the line extending from the high-pressure pump 6 to the depressurizations cells 33 through the heat exchanger 2, the inlet-side passage 53 of the testing unit body 50 was set at 2.7 mm. The diameter of the outlet-side passage was also set at 2.7 mm.

The test was carried out while changing the number and the order of the depressurization cells 33, and a pressure just before the testing unit body 50 was measured using a pressure gauge 58 under the conditions of the flow volume of water: 250, 360 and 440 cc/min. The temperature of the water was maintained at 25° C. by the heat exchanger (cooler) to avoid influence of temperature change.

Figure 6:
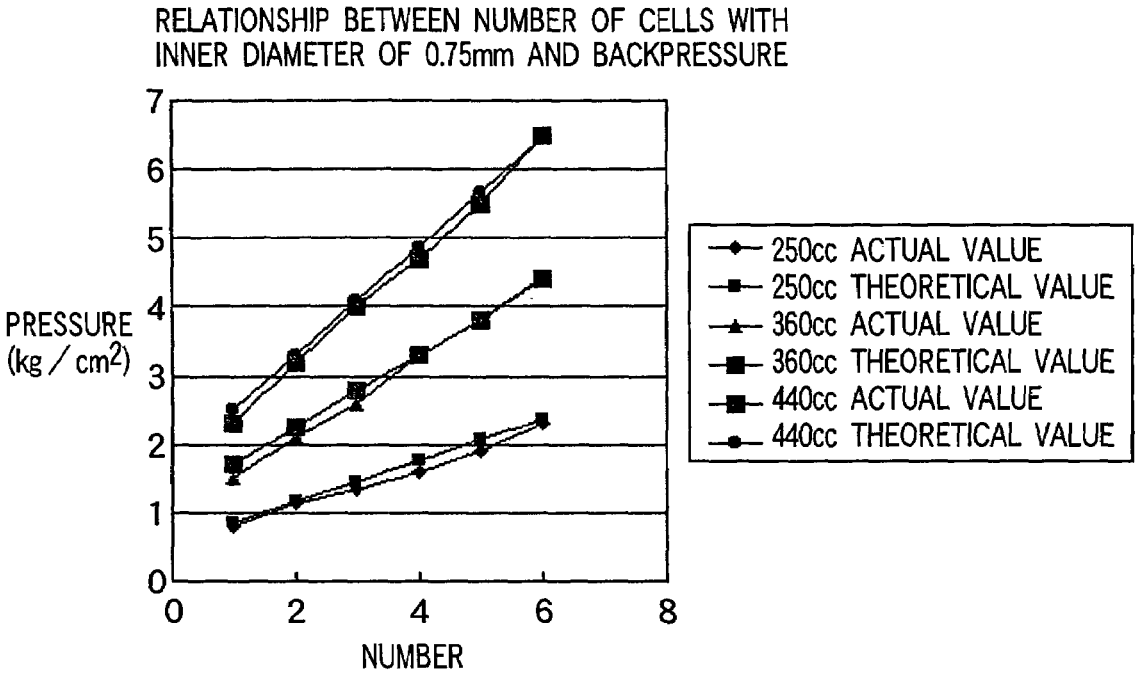
FIG. 6 is a graph showing the relationship between the number of depressurization cells each having an inner diameter showing 0.75 mm, and backpressure.
Figure 7:
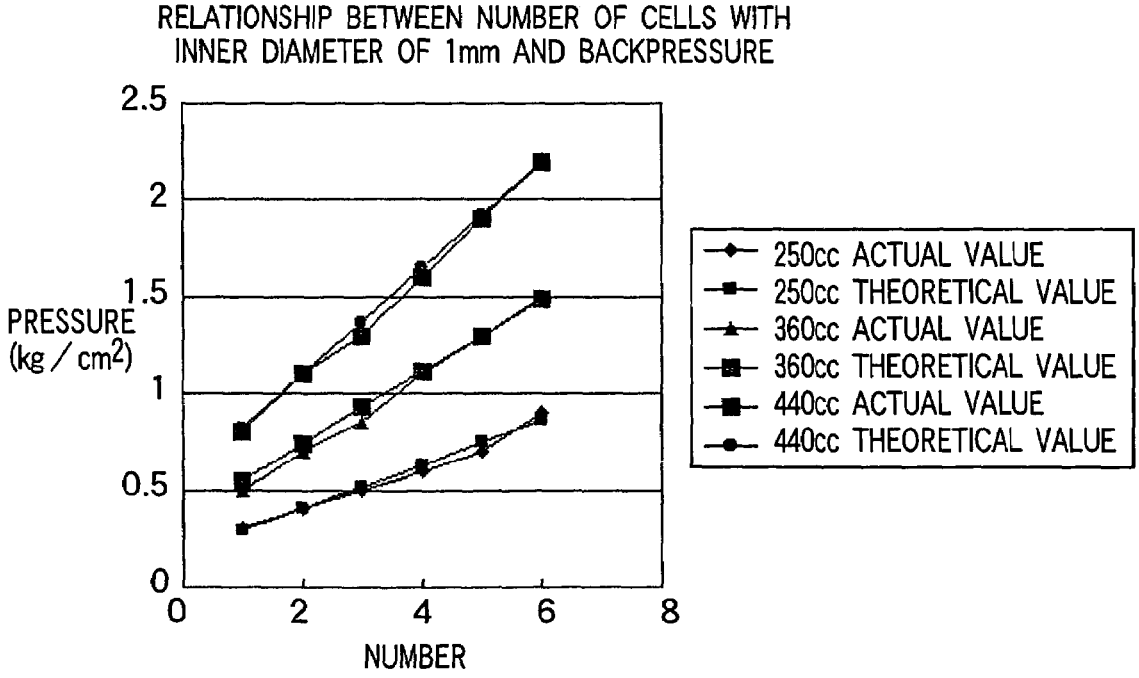
FIG. 7 is a graph showing the relationship between the number of depressurization cells each having an inner diameter of 1.00 mm, and backpressure.

The test result is shown in Tables 1 and 2, and FIGS. 6 and 7. In these data, a theoretical value was determined using the following formula according to hydrodynamics.

Given that a liquid flows at a flow volume Q by a pressure difference h (converted into height) between the upstream end and the down stream end (atmosphere) of a cell having a passage sectional area A, $$Q=cA\sqrt{2gh},$$

wherein c is flow coefficient. Therefore, the pressure difference h is expressed as follows:

$$h=(Q/cA)^2/2g$$

This height h is converted into the unit of pressure, and the converted value is defined as X. The value X indicates a pressure difference (pressure drop) when the liquid passes over the cell.

Further, a pressure loss caused by passing over the cell is determined by the following formula:

$$h'=f\cdot(L/D)\cdot(V^2/2g),$$

wherein f: friction loss coefficient, L: length of the cell, D: inner diameter of the cell, and V: flow velocity.

Given that a value obtained by converting h' into pressure is ΔY, a pressure drop caused by one cell is derived from X+ΔY. In case of two cell, it is expressed by X+2ΔY. In case of n cell, it is expressed by X+nΔY. The theoretical value was calculated based on the above process.

The test result shows that the actual measurement value is approximately matched with the theoretical value. Specifically, it means that when the number of the depressurization cells 33 is N, a pressure difference (backpressure) corresponding to N+ΔY is generated. The backpressure is proportional to the number of the depressurization cells 33.

Table 3 shows the test result for the depressurization cell having an inner diameter of 0.5 mm and a length of 10 mm. As with the above case, the actual measurement value in this case is adequately matched with the theoretical value. The error would be caused by the error in metering of the height pressure pump and/or the error in accuracy of the pressure gauge.

As seen in the above result, according to the cell type, the pressure difference (backpressure) caused by flow can be advantageously calculated using the hydrodynamic fundamental theoretical formula without difficulties. This can be achieved only if the seal interposed between the depressurization cells 33 has a larger inner diameter to block the correlation or interference between the adjacent depressurization cells 33.

For example, in case where a combination of six depressurization cells each having an inner diameter of 1 mm and a length of 10 mm is used in this multistage depressurization module, if the flow volume is 250 cc/min, one of the depressurization cells can depressurize by 0.11 kg/cm$^2$ corresponding to the pressure difference therein.

When the outlet side is opened to atmosphere, the depressurizing function of the depressurization cell on the side of the outlet is preferable to be minimized.

TABLE 1

| | Test Result (1) Cell (Tube) Inner Diameter 0.75 mm Unit: kg/cm$^2$ | | | | | | | |
|---|---|---|---|---|---|---|---|---|
| | 1 | 2 | 3 | 4 | 5 | 6 | flow coef. | fric. loss coef. |
| 250 cc actual value | 0.8 | 1.15 | 1.35 | 1.6 | 1.9 | 2.3 | | |
| 250 cc theor. value | 0.86 | 1.16 | 1.46 | 1.77 | 2.07 | 2.37 | 0.9 | 0.05 |
| 360 cc actual value | 1.5 | 2.1 | 2.6 | 3.3 | 3.8 | 4.45 | | |
| 360 cc theor. value | 1.7 | 2.24 | 2.78 | 3.3 | 3.8 | 4.4 | 0.9 | 0.043 |
| 440 cc. actual value | 2.3 | 3.2 | 4 | 4.7 | 5.5 | 6.5 | | |
| 440 cc theor. value | 2.5 | 3.3 | 4.1 | 4.88 | 5.67 | 6.46 | 0.9 | 0.042 |

TABLE 2

| | Test Result (2) Cell (Tube) Inner Diameter 1 mm Unit: kg/cm$^2$ | | | | | | | |
|---|---|---|---|---|---|---|---|---|
| | 1 | 2 | 3 | 4 | 5 | 6 | flow coef. | fric. loss coef. |
| 250 cc actual value | 0.3 | 0.4 | 0.5 | 0.6 | 0.7 | 0.9 | | |
| 250 cc theor. value | 0.29 | 0.4 | 0.52 | 0.63 | 0.75 | 0.86 | 0.9 | 0.08 |
| 360 cc actual value | 0.5 | 0.7 | 0.85 | 1.1 | 1.3 | 1.5 | | |
| 360 cc theor. value | 0.55 | 0.74 | 0.93 | 1.11 | 1.3 | 1.49 | 0.9 | 0.063 |
| 440 cc actual value | 0.8 | 1.1 | 1.3 | 1.6 | 1.9 | 2.2 | | |
| 440 cc theor. value | 0.82 | 1.1 | 1.37 | 1.65 | 1.92 | 2.2 | 0.9 | 0.062 |

TABLE 3

| | Test Result (3) | | | | | |
|---|---|---|---|---|---|---|
| | flow vol. (cc/min) | 0.5 mm number | flow coef. | fric. loss coef. | actual value (kg/cm$^2$) | theor. value (kg/cm$^2$) |
| 1 | 250 cc | 6 pieces | 0.9 | 0.032 | 13 | 11 |
| 2 | 260 | 6 | 0.9 | 0.032 | 25 | 24 |
| 3 | 440 | 6 | 0.9 | 0.032 | 35 | 36.1 |
| 4 | 250 | 1 | 0.9 | 0.032 | 4.5 | 4.3 |
| 5 | 360 | 1 | 0.9 | 0.032 | 9 | 8.9 |
| 6 | 300 | 12 | 0.9 | 0.032 | 28 | 29 |
| 7 | 440 | 12 | 0.9 | 0.032 | 63 | 63.5 |

The inventors checked up the possibility of the occurrence of bubbling in the multistage depressurization module using various combinations of depressurization cells different in passage diameter. As a result, it was found that the combinations determined in conformity with the following rules have no bubbling, and the combinations against the rules have bubbling.

(Rule 1) In a combination of cells each having either one of at least three different passage diameters with a relationship of $D_S<D_M<D_B$, when a first cell with the passage diameter $D_M$ is connected to the downstream of a second cell with the passage diameter $D_S$, a third cell with the passage diameter $D_B$ is interposed between the fist and second cells. That is, the first cell with the passage diameter $D_M$ should not be connected directly to the downstream of the second cell with the passage diameter $D_S$, but must be connected to the downstream of the second cell with the passage diameter $D_s$ through the third cell with the passage diameter $D_B$.

(Rule 2) The Rule 1 is not essentially applied when any of the cells is connected to the upstream side of a cell with the smallest passage diameter.

Figure 8:
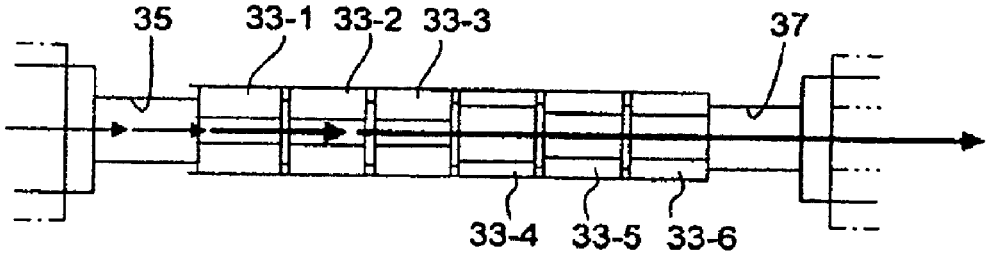
FIG. 8 is an explanatory sectional view corresponding to FIG. 3, which shows one example of the arrangement of the absorption cells.

FIG. 8 shows a preferred combination of cells different in passage diameter. Given that each of an inlet passage 35 and an outlet passage 37 has a passage diameter Dc; a seal 34 has a passage diameter $D_Q$; each of three depressurization cells 33-1, 33-2, 33-3 on the upstream side has a passage diameter Ds; a 4-th depressurization cell 33-4 has a passage diameter $D_B$; and each of two depressurization cells 33-5, 33-6 on the downstream side has a passage diameter $D_M$, the following relationship is satisfied:

$$Dc \geqq D_Q > D_B \geqq D_M \geqq Ds$$

Further, these cells are connected with each other in a relationship of $Ds \rightarrow D_B \rightarrow D_M$, which is satisfy the relationship defined in the above (Rule 1).

The inventors have also been experimentally verified that the above Rules are applicable to a combination of the absorption cells of the multistage emulsification/dispersion controller as well as the multistage depressurization module, and any combination of the absorption cells different in passage diameter, unconformable to the above Rules has bubbling in the outlet of the multistage emulsification/dispersion controller.

For example, in case of the multistage emulsification/dispersion module illustrated in FIGS. 2 and 3, the (Rule 2) is applied because the absorption cell with the smallest diameter is located at the downstreammost end of the module.

As a conclusion, the above Rules are applicable to the entire assembly composed of all passage elements interposed in the passage ranging from the multistage emulsification/dispersion controller to the multistage depressurization module. More specifically, given that each of the respective absorption cells, the inlet passage of the multistage emulsification/dispersion controller, the outlet passage of the multistage emulsification/dispersion controller, the communication passage connecting between the multistage emulsification/dispersion controller and the multistage depressurization module (including the passage of the heat exchanger), the respective depressurization cells, the inlet passage of the multistage depressurization module, and outlet passage of the multistage depressurization module, is defined as a passage unit, the above Rules are applied to any connection relationship of these passage units.

From this point of view, the above Rules are further generalized as follows.

(Rule 1) Each of the passage units has either one of at least three different passage diameters $D_S$, $D_M$, $D_B$ ($D_S<D_M<D_B$), wherein when the passage unit with the passage diameter $D_M$ is connected to the downstream of the passage unit with the passage diameter $D_S$, the passage unit with the passage diameter $D_B$ is connected between the above two passage units.

(Rule 2) The (Rule 1) is not essentially applied when any of the passage units is connected to the upstream side of the passage unit with the smallest passage diameter Ds (exceptional rule for the (Rule 1)).

In either case, the respective inner diameter and/or the number of the depressurization cells may be selectively determined optimally to a required depressurization treatment and/or characteristics of a product to be treated. In some cases, two or three depressurization cells may be used as a single depressurization cell unit without interposing any seal 34 therebetween. Even in such a case, if two of the depressurization cells have different passage diameters, they must be connected with one another through the seal 34.

Second Embodiment

Figure 9:
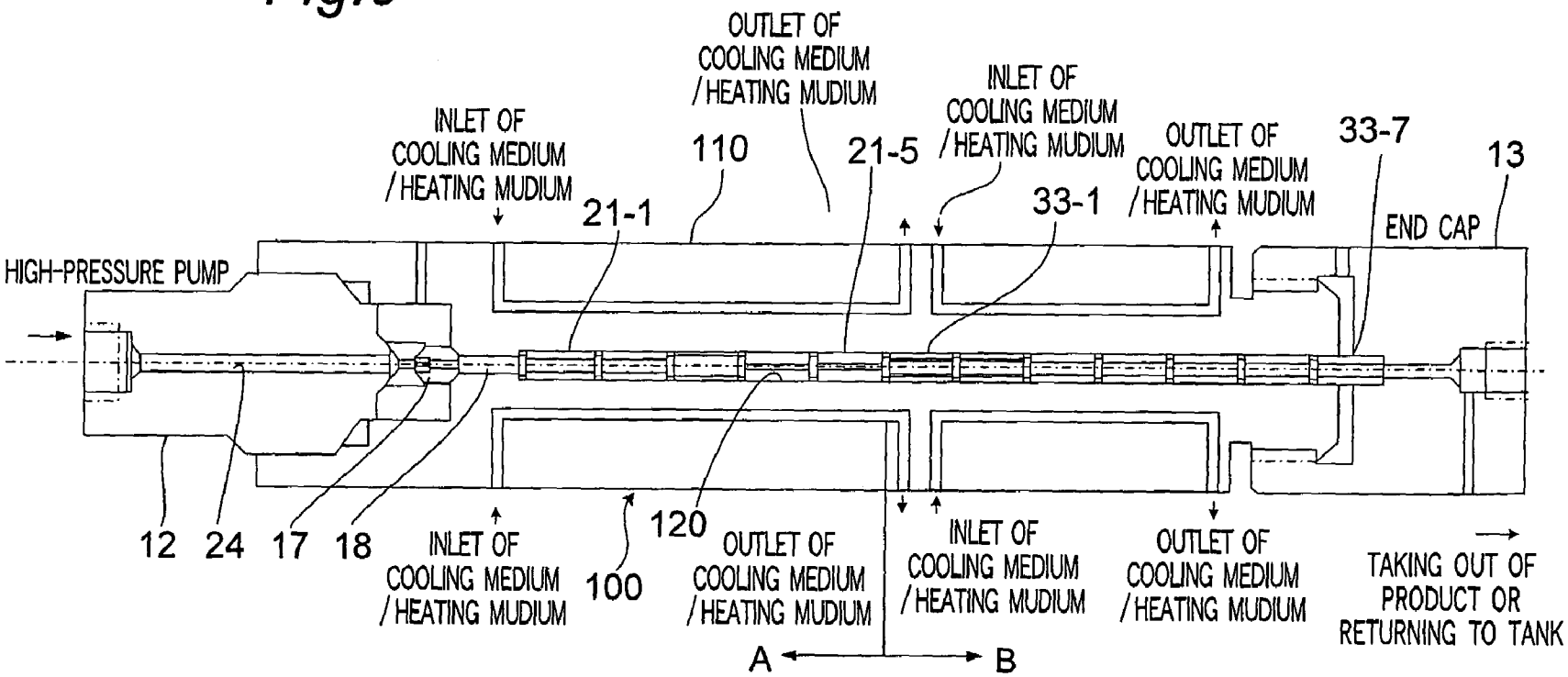
FIG. 9 is an explanatory axial sectional view showing a second embodiment of the present invention.

FIG. 9 shows a multistage emulsification/dispersion apparatus constructed by integrating the multistage emulsification/dispersion module in FIG. 2 and the multistage depressurization module in FIG. 4. In FIG. 9, a front-half portion designated by the arrow. A is to a multistage emulsification/dispersion controller 100, and a rear-half portion designated by the arrow B corresponds to a multistage depressurization module.

In this embodiment, an apparatus body 110 is formed as a long columnar body, and formed with an axial hole 120 extending from the rear end thereof to be brought into communication with a first passage 18 continuing to a nozzle 17 provided at the front end thereof. Five absorption cells 21-1, - - - , 21-5 with inner diameters having the same relation as that in FIG. 2 are arranged in the front-half portion of the axial hole 120 in series in a multistage manner, and seven depressurization cells 33-1, - - - , 33-7 are arranged to continue from the 5-th absorption cell 21-5, in series in a multistage manner.

The series of absorption cells 21-1, - - - , 21-5 and depressurization cells 33-1, - - - , 33-7 are pressingly held in the axial direction by an end cap 13 threadingly engaged with the outlet side of the apparatus body 110.

Except for being devoid of a heat exchanger (2 in FIG. 1), the fundamental function of the second embodiment is not different from that of the first embodiment.

Based on the embodiment illustrated in FIG. 9, one example of cell diameter setting and pressure drop will be described below.

Given that a pressure in the upstream of the nozzle 17 (nozzle diameter: 0.14 mm, length: 1.5 mm): 1000 kg/cm$^2$, a flow volume: 340 cc/min, a flow coefficient: 0.9, and a friction loss coefficient: 0.032.

| Cell Diameter (from upstream side) | Pressure in just upstream of Cell (kg/cm$^2$) |
|---|---|
| 1 mm | 12.388 |
| 1 mm | 11.898 |
| 2 mm | 11.488 |
| 0.5 mm | 11.465 |
| 0.5 mm | 8.74 |
| 2 mm | 0.775 |
| 2 mm | 0.773 |
| 1 mm | 0.75 |
| 1 mm | 0.66 |

-continued

| Cell Diameter (from upstream side) | Pressure in just upstream of Cell (kg/cm$^2$) |
|---|---|
| 1 mm | 0.58 |
| 1 mm | 0.49 |
| 1 mm | 0.41 |

Each of the cells is set to have a length of 10 mm, and the pressure is reduced to an atmospheric pressure in the outlet passage.

In FIG. 9, the same element as or a corresponding element to that in FIG. 2 is defined by the same reference numeral, and its description will be omitted.

Figure 10:
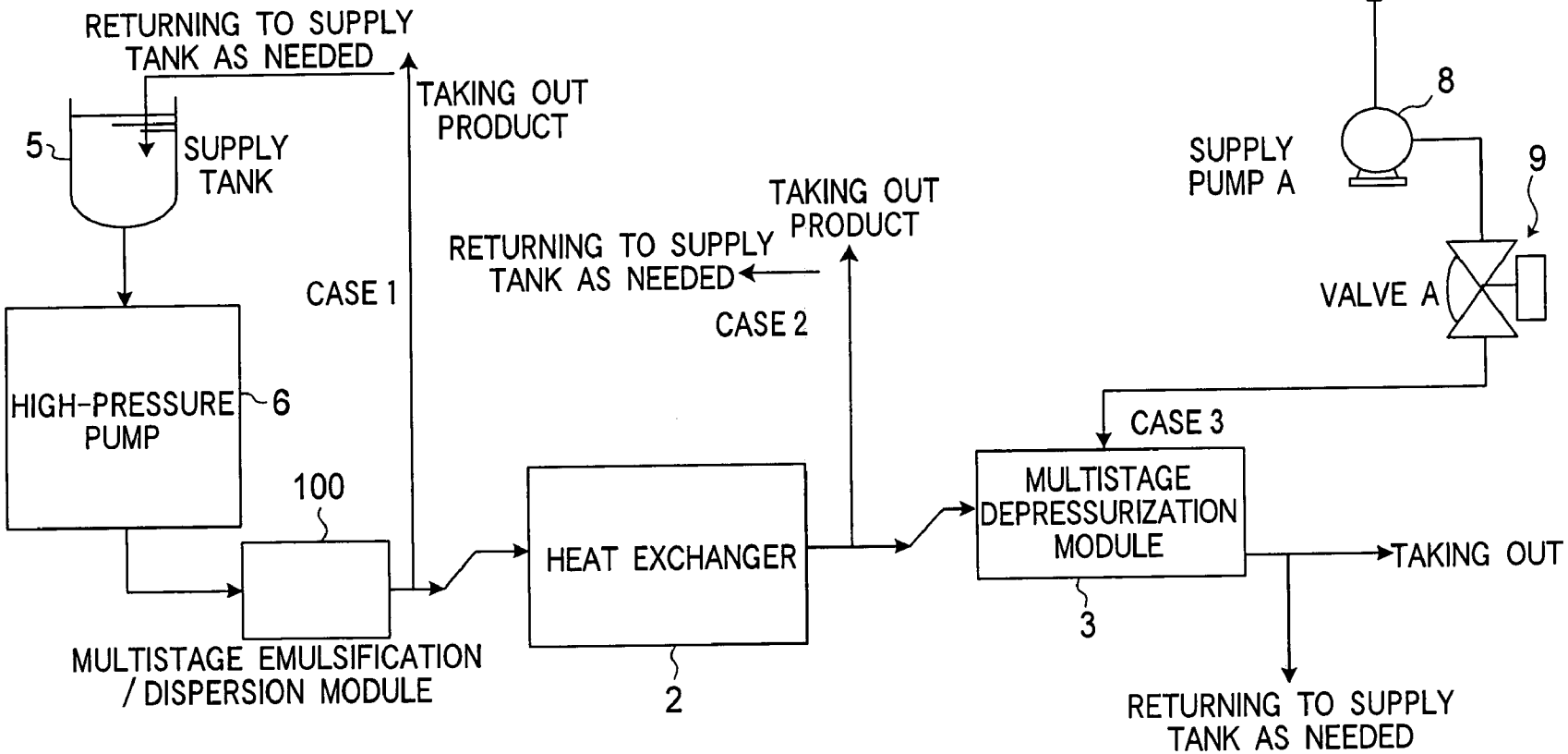
FIG. 10 is a block diagram of an emulsification/dispersion system using an emulsification/dispersion unit in FIG. 9.

FIG. 10 shows three modes (hereinafter referred to as "Mode 1, Mode 2, Mode 3") of a system arrangement using the integrated multistage emulsification/dispersion apparatus 100.

Mode 1 is designed such that an emulsified/dispersed liquid or a product is taken out directly from the outlet of the integrated multistage emulsification/dispersion apparatus 100. In case where a product can be taken out in its high-temperature state without any problems, or it is desired to take out a product in its high-temperature state, this system may be employed.

The emulsified/dispersed liquid may be retuned to a supply tank 5 and re-emulsified/dispersed, according to need.

Mode 2 is designed such that the integrated multistage emulsification/dispersion apparatus 100 is connected to a heat exchanger to allow a product to cooled to an appropriate temperature by the heat exchanger and then taken out. The cooling is effective to prevent the occurrence of bubbling.

In Mode 2, the emulsified/dispersed liquid may also be retuned to the supply tank 5, and re-emulsified/dispersed.

Mode 3 is a system arranged such that the multistage depressurization module 3 is connected to the downstream of the heat exchanger 2. Mode 3 may be effectively used in case where there is the need for applying a higher backpressure to the integrated multistage emulsification/dispersion apparatus 100.

As described in connection with FIG. 1, the system of Mode 3 can be arranged such that an additive-containing liquid stored in a second supply tank 7 is pressurized up to the backpressure by a supply pump 8, and then supplied to the inlet side of multistage depressurization module 3 through a valve 9. The supplied additive is dispersedly mixed in the emulsified/dispersed liquid approximately uniformly according to repetitive depressurization based on depressurization cells 33 and repetitive pressure relaxation based on seals 34.

The liquid discharged from the multistage depressurization module 3 may be taken out as a final product, or may be returned to the supply tank 5 and re-emulsified/dispersed.

Third Embodiment

Figure 11:
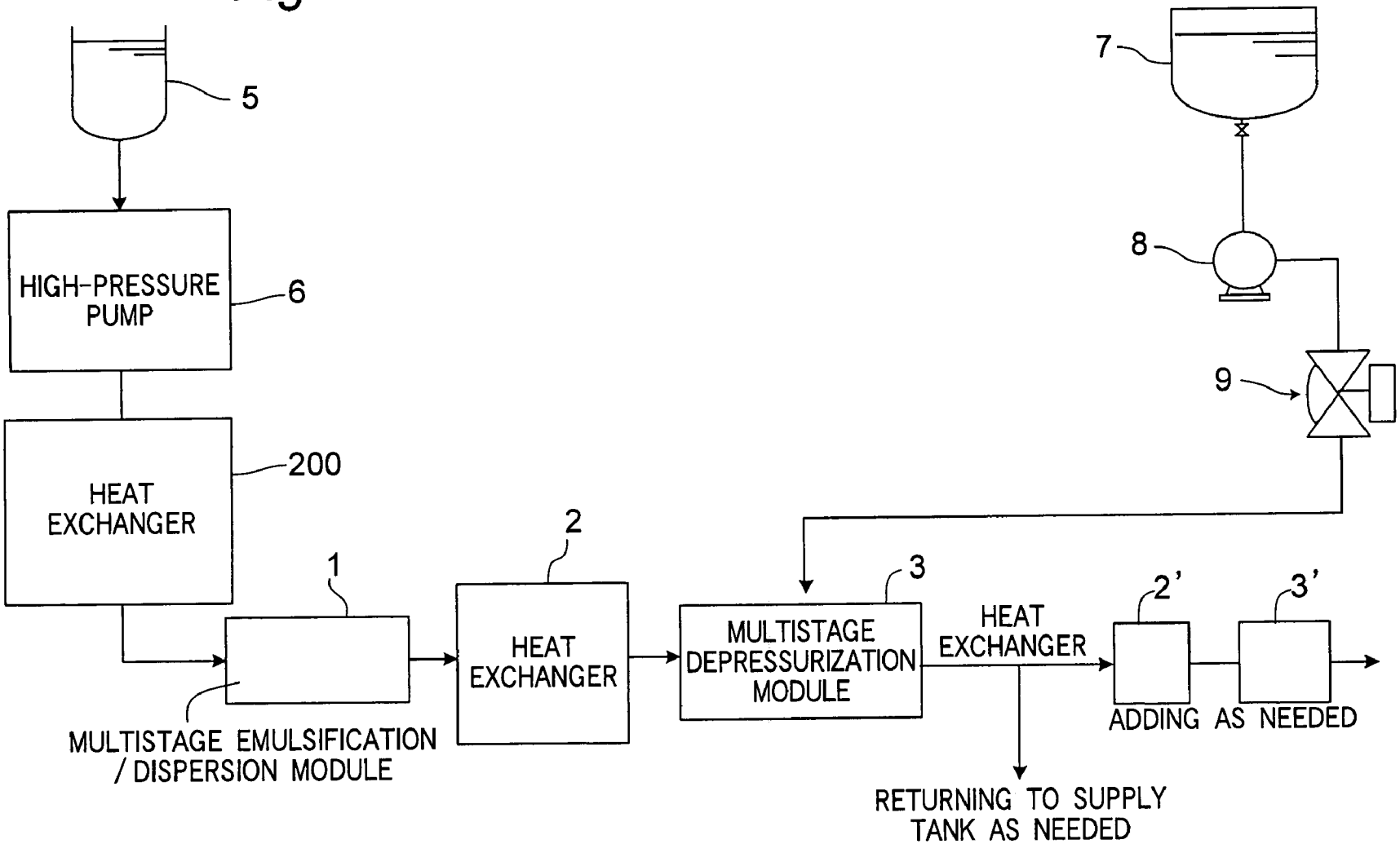
FIG. 11 is a system block diagram showing a third embodiment of the present invention.

FIG. 11 shows one application (third embodiment) of the multistage emulsification/dispersion system as shown in FIG. 1, which is intended to utilize the critical state of a liquid (e.g. water, water/ethanol solution, ethanol).

As shown in FIG. 11, a dispersion liquid contained power or lecithin dispersed in a liquid (e.g. water) is stored in a supply tank 5, and then pressurized up to a given pressure required for the critical state of the liquid (218.4 atm for water), or more, for example, 1.000 atm, by a high-pressure pump 6. A heat exchanger 200 serving as heating means is provided in the subsequent stage of the high-pressure pump 6, to heat the dispersion liquid up to the critical point of the liquid (critical temperature of water: 374.2° C.), or more, for example 400° C., so as to achieve the critical state of the solution.

The dispersion liquid in the critical state is supplied to a multistage emulsification/dispersion controller 1. If water serving as a solvent is in its critical state, even an insoluble material such as lecithin can have solubility and/or dispersibility. Thus, when the dispersion liquid is injected into the multistage emulsification/dispersion controller 1 at a high speed, the emulsification/dispersion of the liquid is further accelerated by a string shearing force. This provides a possibility of achieving the emulsification/dispersion between water and oil without using any surfactant.

The inner space of the multistage emulsification/dispersion controller 1 has a high temperature and a high pressure, and a required backpressure is assured by a multistage depressurization module 3 provided in the subsequent stage of a heat exchanger 2 and/or another multistage depressurization module 3' provided in the further subsequent stage. The emulsified/dispersed liquid discharged from the multistage emulsification/dispersion controller 1 is cooled by the heat exchanger 2, and the cooled emulsified/dispersed liquid is depressurized by the multistage depressurization module 3. In case where a desired result cannot be sufficiently obtained only by one cycle of cooling and depressurization, or the temperature/pressure conditions still involve the risk of causing bubbles if the emulsified/dispersed liquid is released directly to atmosphere, another heat exchanger 2' and multistage depressurization module 31 are additionally connected to provide sufficient cooling and depressurization so as to prevent the occurrence of bubbling.

In this manner, after the emulsification/dispersion in the critical state based on shearing force, a final product can be obtained without bubbling while maintaining an adequate emulsified/dispersed state.

According to need, the emulsified/dispersed liquid may be returned to the supply tank 5 and re-emulsified/dispersed, and/or an additive may be additionally supplied from a second supply tank 7 to the inlet side of the multistage depressurization module 3 through a supply pump 8 and a valve 9.

[Applications of Multistage Depressurization Module]

The multistage depressurization module 3 according to the present invention can control a backpressure required for the emulsification/dispersion apparatus or a backpressure capable of suppressing the occurrence of bubbling therein, and can reduce the backpressure in a stepwise manner to allow an emulsified/dispersed liquid to finally have a reduced pressure causing no bubbling even if it is released to atmosphere. Further, the respective inner diameters/lengths and the number of the depressurization cells can be variously combined to control the backpressure and the depressurization of the backpressure with high flexibility.

Thus, this multistage depressurization module can be effectively combined with conventional high-pressure or rotary type emulsification/dispersion apparatuses.

Examples of such an application are shown in FIGS. 12 to 16.

Figure 12:
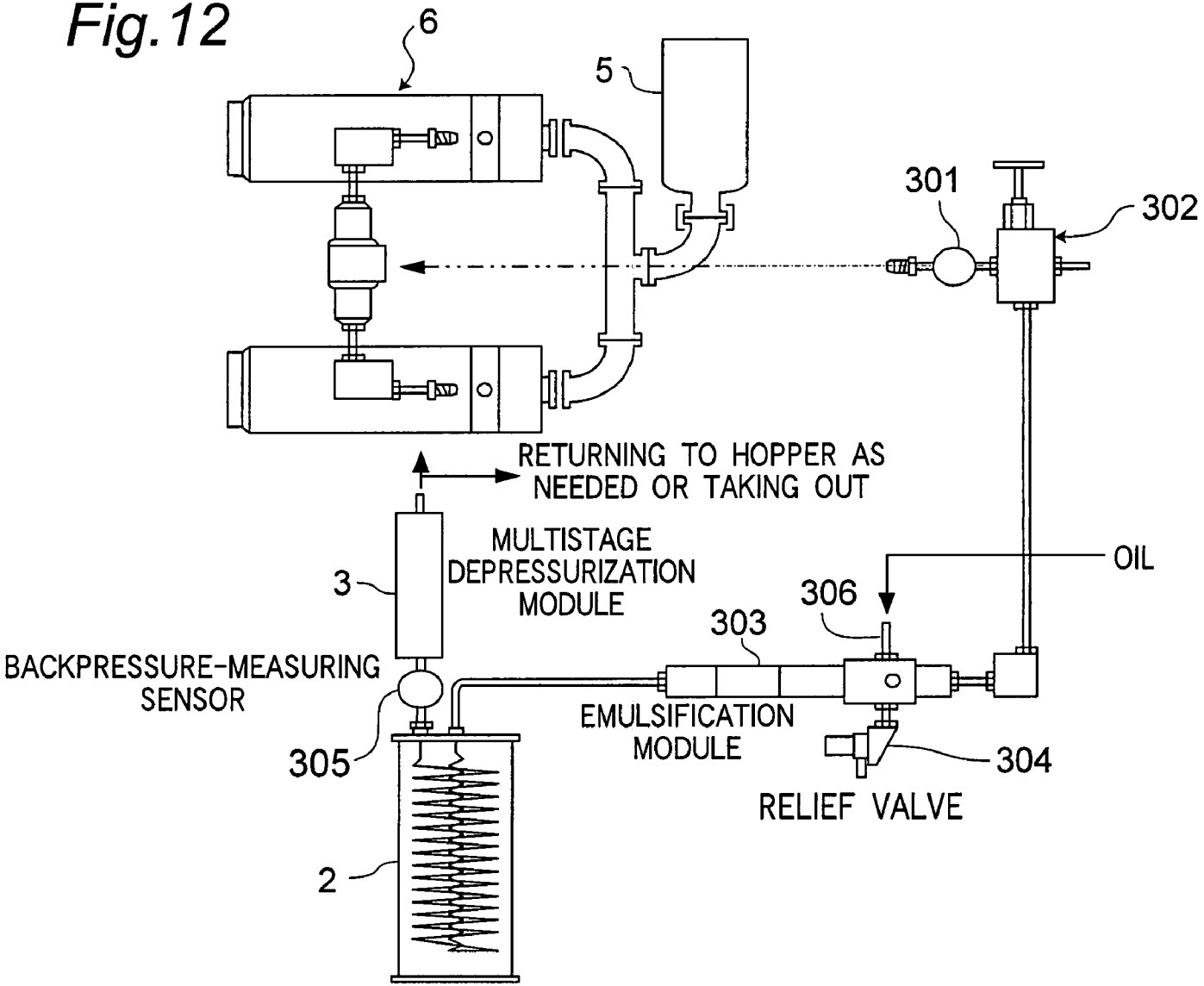
FIG. 12 is a system block diagram showing one example where the present invention is applied to a DeBEE 2000 dual type.
Figure 13:
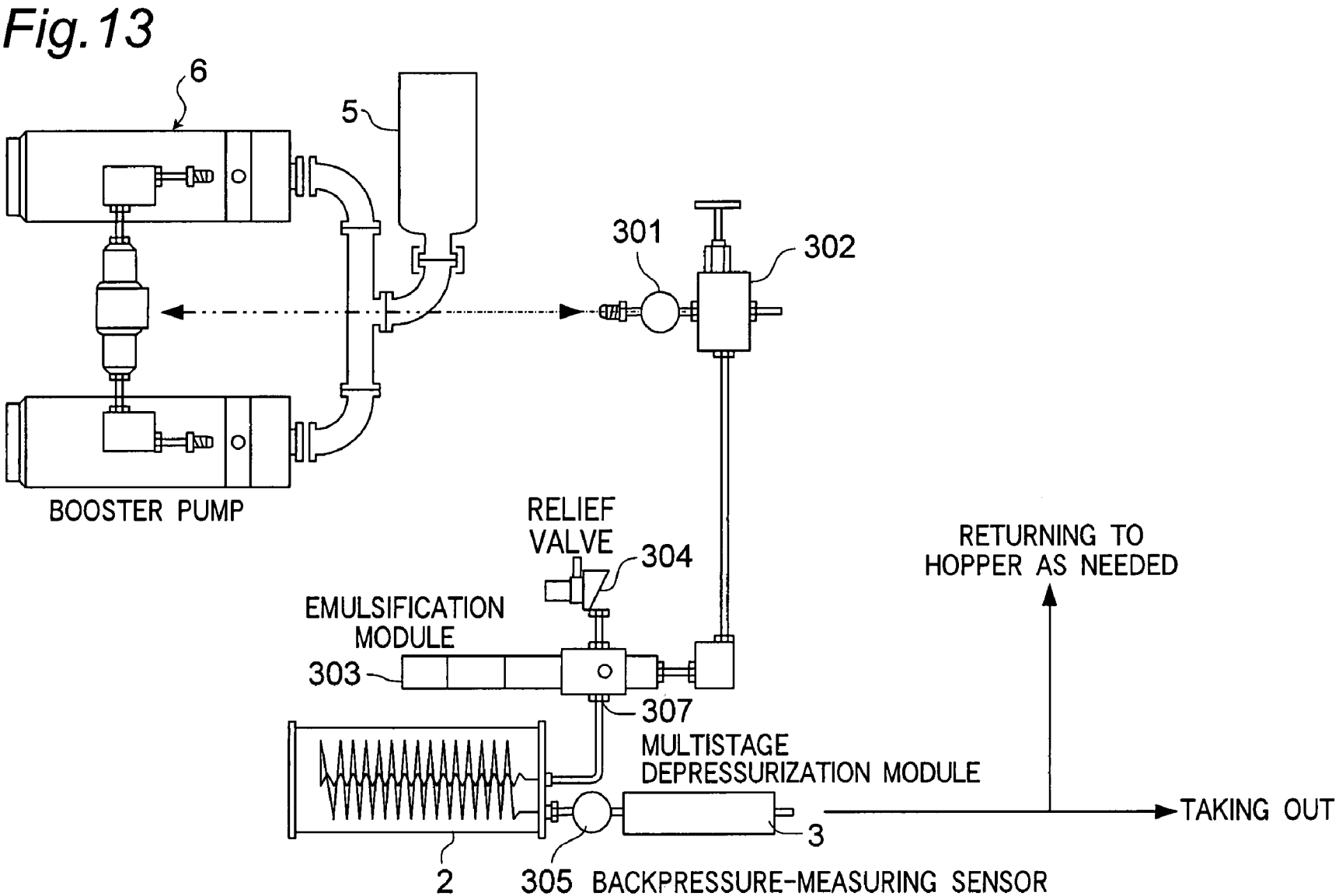
FIG. 13 is a system block diagram showing another example where the present invention is applied to a DeBEE 2000 reverse type.

FIG. 12 shows one application to a high-pressure type homogenizer commercially available as a DeBEE 2000 dual type, and FIG. 13 shows one application to a high-pressure type homogenizer commercially available as a DeBEE 2000 reverse type.

The DeBEE 2000 is a type designed to inject a high-speed jet of 500 feet/sec or more into absorption cells arranged in series in a multistage manner, and emulsify/disperse a liquid by means of liquid-liquid shear in the interface between the high-speed jet and a low-speed liquid flow formed around the high-speed jet. The details can be referred to Japanese Patent Laid-Open Publication No. 09-507791. The dual type herein means a type in which a liquid is supplied from the side of a jet flow by use of a suction force of the jet flow, and the reverse type means a type in which the emulsification/dispersion is induced by means of liquid-liquid shear between a jet flow and a low-speed liquid flow flowing back from a closed downstream end.

In FIGS. 12 and 13, the reference numeral 5 indicates a supply tank; 6 indicates a high-pressure pump; 301 indicates a pressure sensor; 302 indicates an air vent valve; 303 indicates an emulsification module; 304 indicates a relief valve; 2 indicates a heat exchanger; 305 indicates a back-pressure-measuring sensor; and 3 indicates a multistage depressurization module.

In the dual type illustrated in FIG. 12, a material, such as oil, to be emulsified is supplied from a side port 306 on the inlet side of the emulsification module 303, and a resulting emulsified liquid is taken out of the rear end of the emulsification module 303.

In the reverse type illustrated in FIG. 13, a back-flowing emulsified liquid is taken out of a side port 307 of the inlet end.

In both the types, the multistage depressurization module 3 is operable to provide a backpressure required for preventing bubbling in the emulsification module 303 likely to be induced by a strong shearing force, and to reduce the backpressure in a stepwise manner to prevent the occurrence of bubbling when a product is taken out.

Figure 14:
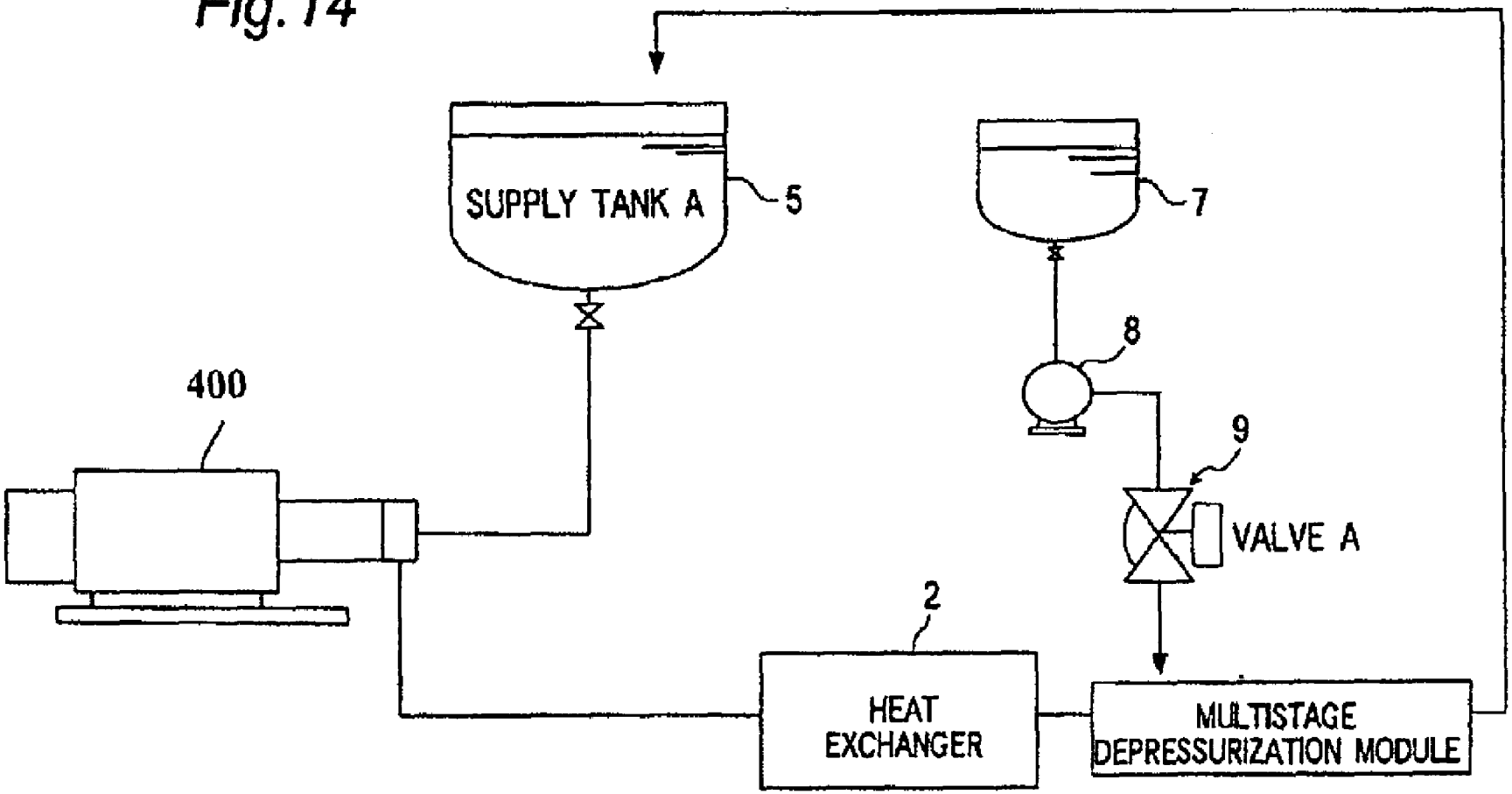
FIG. 14 is a system block diagram showing still another example where the present invention is applied to an inline-type rotary homogenizer.
Figure 15:
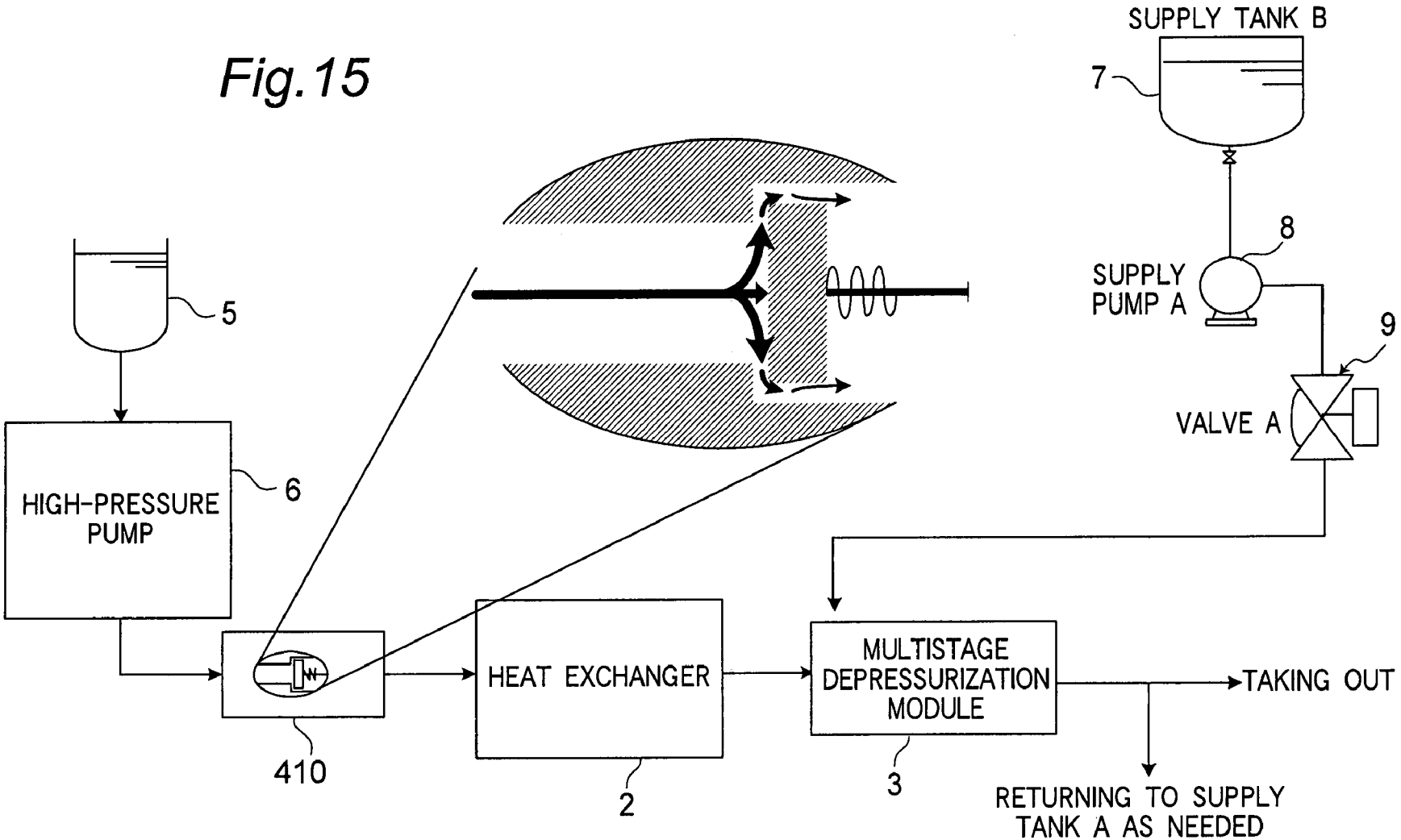
FIG. 15 is a system block diagram showing yet another example where the present invention is applied to a Gaulin-type homogenizer.
Figure 16:
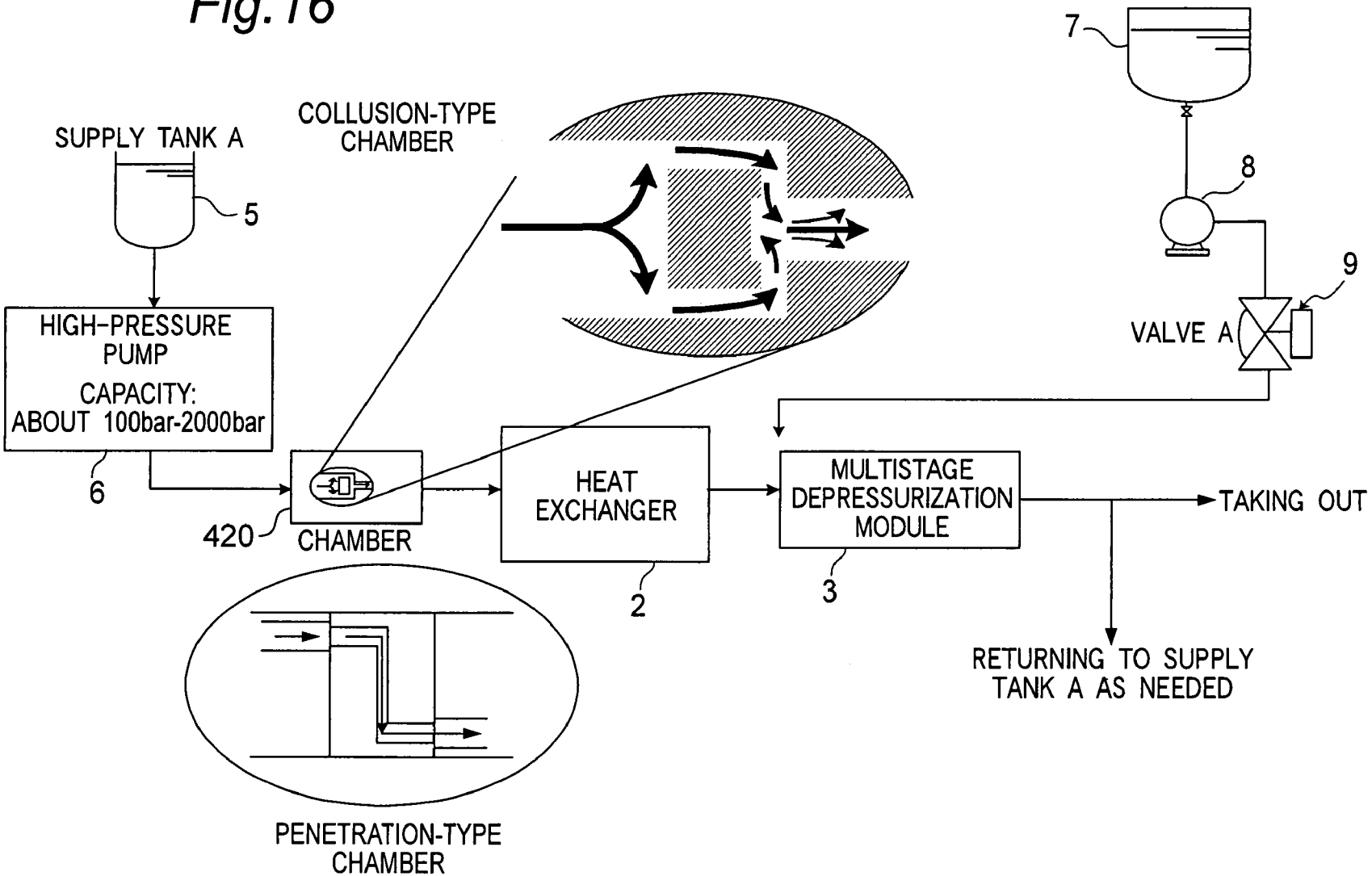
FIG. 16 is a system block diagram showing still yet another example where the present invention is applied to a nozzle-fixed type homogenizer.

FIGS. 14, 15 and 16 show examples in which the multistage depressurization module 3 is applied to an inline rotary type homogenizer 400, a Gaulin-type homogenizer 410, a nozzle fixed-type high-pressure homogenizer (microfluidizer, nanomizer) 420, respectively.

In these conventional homogenizers, the problem of bubbling due to a strong shearing force comes to the front as the rotation speed and/or pressure are increased. The multistage depressurization module 3 can be used therewith to provide a required backpressure for preventing the occurrence of bubbling and allow a product to be taken out without bubbling.

In FIGS. 14 to 16, the same element as or a corresponding element to that in FIG. 1 is defined by the same reference numeral, and its description will be omitted.

As can be understood from the above description, the multistage depressurization module according to the present invention can apply a high backpressure to the emulsification/dispersion apparatus according to need, and can reduce the high backpressure in a stepwise manner to reliably prevent the occurrence of bubbling when a dispersed/emulsified liquid is released to atmosphere.

The emulsification/dispersion apparatus may be any commonly used or conventional type. They can be combined with the multistage depressurization module of the present invention to set up an allowable speed and/or pressure at a higher value so as to obtain an enhanced performance for creating emulsified/dispersed liquids.

The multistage emulsification/dispersion module according to the present invention can be constructed by combining a plurality of absorption cells different in inner diameter, to allow a high backpressure for preventing the occurrence of bubbling to be achieved in a liquid passage so as to perform the emulsification/dispersion using on a high shearing force while suppressing the occurrence of bubbling.

The multistage emulsification/dispersion module and the multistage depressurization module may be integrated as a single unit. In this case, a product can be taken out from the unit without the occurrence of bubbling.

In addition, a multistage depressurization system using the multistage depressurization module may be employed. In this case, after a dispersion liquid is highly pressurized and heated to achieve its critical state, a multistage emulsification/dispersion module is preferably used to perform emulsification/dispersion. While the emulsification/dispersion is required to be performed under a sufficiently high backpressure because the high-temperature heating is liable to cause bubbling or flushing, cooling and depressurization can be reputed as needed to prevent the occurrence of bubbling even if an emulsified/dispersed liquid is released to atmosphere. In a critical state, an enhanced solubility, which cannot be observed in the liquid phase, is obtained. Thus, it can be expected to obtain an emulsion of water/lecithin or water/oil without any surfactant by applying a high shearing force to the dispersion liquid in the critical state.

INDUSTRIAL APPLICABILITY

As mentioned above, the emulsification/dispersion system using the multistage module according to the present invention is useful particularly in the emulsification/dispersion requiring a high shearing force, and suitable for use in homogenizers or the like.

What is claimed is:

1. An emulsification/dispersion system comprising:

a supplier that supplies a liquid metal to be emulsified/dispersed;

an emulsification/dispersion apparatus for emulsifying/dispersing said liquid metal supplied from said supplier, by applying a shearing force;

a communication passage connect to an outlet portion of said emulsification/dispersion apparatus; and a multistage depressurization module connected to the downstream of said communication passage, said multistage depressurization module including an inlet passage, an outlet passage, and at least two depressurization members located between said inlet and outlet passages and connected with each other in a multistage manner through a connection member, said multistage depressurization module being operable to apply to a given backpressure to the outlet portion of said emulsification/dispersion apparatus and to reduce said backpressure in a stepwise manner so that the depressurization member in the final stage provides a reduced pressure causing no bubbling in said outlet passage.

2. The emulsification/dispersion system according to claim 1, wherein said depressurization members are composed of at least one first depressurization member having a first inner diameter $d_1$, at least one second depressurization member having a second inner diameter $d_2$ and at least one third depressurization member having a third inner diameter $d_3$, which are arranged in this order from the upstream side, wherein said first to third inner diameters $d_1$, $d_2$, and $d_3$ are designed to satisfy the following relationship: $d_0>d_3>d_1$ and $d_2>d_3>d_1$, wherein $d_0$ is the passage diameter of said outlet passage.

3. The emulsification/dispersion system according to claim 2, which satisfies the following relationship: $d_S>d_2$, wherein $d_S$ is the inner diameter of said connection member.

4. The emulsification/dispersion system according to claim 1, wherein all of said depressurization members have the same inner diameter, or at least one of said depressurization members on the downstream side has an inner diameter less than that of at least one of the remaining depressurization members on the upstream side.

5. The emulsification/dispersion system according to claim 4, wherein said connection member has an inner diameter greater than that of each of said depressurization members.

6. The emulsification/dispersion system according to claim 1 , which includes a heat exchanger interposed in said communication passage.

7. A multistage emulsification/dispersion system comprising:

a supplier for pressurizing a liquid material to be emulsified/dispersed, and supplying said pressurized liquid material;

a multistage emulsification/dispersion module including an inlet portion having an orifice, an outlet portion, a plurality of absorption cells interposed in a passage extending from said inlet and outlet portions and connected with each other in a multistage manner through a connection member;

a communication passage connected to an outlet portion of said multistage emulsification/dispersion module; and a multistage depressurization module including an inlet passage connected to the downstream of said communication passage; an outlet passage opened to atmosphere, a plurality of depressurization members located between said inlet and outlet passages and connected with each other in a multistage manner through a connection member, said depressurization members being composed of at least one first depressurization member having a first inner diameter $d_1$, at least one second depressurization member having a second inner diameter $d_2$ and at least one third depressurization member having a third inner diameter $d_3$, which are arranged in this order from the upstream side, wherein said first to third inner diameters $d_1$, $d_2$, and $d_3$ are designed to satisfy the following relationship: $d_0>d_3>d_1$ and $d_2>d_3>d_1$, wherein $d_0$ is the passage diameter of said outlet passage.

8. The multistage emulsification/dispersion system according to claim 7, wherein said plurality of absorption cells of said multistage emulsification/dispersion module are composed of at least one first absorption cell having a first inner diameter $D_1$, at least one second absorption cells having a second inner diameter $D_2$ and at least one third absorption cell having a third inner diameter $D_3$, which are arranged in this order from the side of said oritice means, wherein said diameters $D_1$, $D_2$, $D_3$ are designed to satisfy the following relationship: $D_2>D_1>D_3$.

9. The multistage emulsification/dispersion system according to claim 7, which includes a heat exchanger interposed in said communication passage.

10. A multistage emulsification/dispersion system comprising:

a supplier for pressurizing a liquid material to be emulsified/dispersed, and supplying said pressurized liquid material;

a multistage emulsification/dispersion module including an inlet portion having an orifice, and outlet portion, a plurality of absorption cells interposed in a passage extending from said inlet and outlet portions and connected with each other in a multistage manner through a connection member;

a communication passage connected to an outlet portion of said multistage emulsification/dispersion module; and a multistage depressurization module including an inlet passage connected to the downstream of said communication passage, an outlet passage opened to atmosphere, a plurality of depressurization members located between said inlet and outlet passages and connected with each other in a multistage manner through a connection member, wherein, provided said respective absorption cells, said communication passage and said respective depressurization members are defined as individual passage units each having a given passage diameter, the respective passage diameters of said passage units are determined according to the following rules:

(1) each of said passage units has either one of at least three different passage diameters $D_S$, $D_M$, $D_B$ ($D_S>D_M>D_B$), wherein when the passage unit with the passage diameter $D_M$ is connected to the downstream of the passage unit with the passage diameter $D_S$, the passage unit with the passage diameter $D_B$ is connected between said two passage units; and (2) said rule (1) is not essentially applied when any of said passage units is connected to the upstream side of the passage unit with the smallest passage diameter.

11. The multistage emulsification/dispersion system according to claim 10, which satisfies the following relationship $D_Q \geqq D_B$, wherein $D_Q$ is the inner diameter of said connection member.

12. A method of producing an emulsified/dispersed liquid, comprising the steps of:

giving a shearing force to a supplied liquid material to emulsify/disperse said liquid material, which applying to said liquid material a backpressure allowing said emulsification/dispersion to be performed without bubbling; and reducing the backpressure of said emulsified/dispersed liquid in a stepwise manner so as to allow said emulsified/dispersed liquid to finally have a reduced pressure causing no bubbling even if it is released to atmosphere.

13. A method of producing an emulsified/dispersed liquid, comprising the steps of:

pressurizing and heating a dispersion liquid up to a given pressure or more and a given temperature of more to achieve the critical state of said dispersion liquid and giving a high shearing force to said dispersion liquid in critical state to cause emulsification/dispersion therein while applying a backpressure thereto; and reducing the backpressure of the obtained emulsified/dispersed liquid in a stepwise manner using a plurality of depressurization members so as to allow said emulsified/dispersed liquid to finally have a reduced pressure causing no bubbling even if it is released to atmosphere.

* * * * *

UNITED STATES PATENT AND TRADEMARK OFFICE

CERTIFICATE OF CORRECTION

PATENT NO. : 7,284,899 B2
APPLICATION NO. : 10/501031
DATED : October 23, 2007
INVENTOR(S) : Nakano It is certified that error appears in the above-identified patent and that said Letters Patent is hereby corrected as shown below:

Column 16, line 56: “the side of said oritice” should read --side of said orifice--.
Column 18, line 20: “temperature of more” should read --temperature or more--.

Signed and Sealed this

Thirteenth Day of May, 2008

JON W. DUDAS
*Director of the United States Patent and Trademark Office*